US008540176B2

(12) United States Patent
Wallin et al.

(10) Patent No.: US 8,540,176 B2
(45) **Date of Patent: *Sep. 24, 2013**

(54) CRUSHING PLANT AND METHOD FOR CONTROLLING THE SAME

(75) Inventors: Jonny Wallin, Malmö (SE); Christer Dagh, Kilafors (SE); Olle Hedin, Alfta (SE); Tommy Renberg, Umeå (SE)

(73) Assignee: Sandvik Intellectual Property AB, Sandviken (SE)

( * ) Notice: Subject to any disclaimer, the term of this patent is extended or adjusted under 35 U.S.C. 154(b) by 279 days.

This patent is subject to a terminal disclaimer.

(21) Appl. No.: 12/664,299

(22) PCT Filed: May 5, 2008

(86) PCT No.: PCT/SE2008/000306

§ 371 (c)(1),
(2), (4) Date: Mar. 8, 2010

(87) PCT Pub. No.: WO2008/153464

PCT Pub. Date: Dec. 18, 2008

(65) Prior Publication Data

US 2010/0181397 A1 Jul. 22, 2010

(30) Foreign Application Priority Data

Jun. 15, 2007 (SE) ..... 0701459

(51) Int. Cl.
*B02C 25/00* (2006.01)

(52) U.S. Cl.
USPC ..... 241/30; 241/35; 241/207; 241/214

(58) Field of Classification Search
USPC ..... 241/30, 34, 35, 207–216
See application file for complete search history.

(56) References Cited

U.S. PATENT DOCUMENTS

| | | | | |
|---|---|---|---|---|
| 5,277,269 | A * | 1/1994 | Ichimura et al. | 180/306 |
| 5,477,679 | A * | 12/1995 | Tatsumi et al. | 60/431 |
| 5,509,610 | A * | 4/1996 | Gibbons et al. | 241/37 |
| 6,016,979 | A * | 1/2000 | Squires et al. | 241/35 |
| 6,119,967 | A * | 9/2000 | Nakayama et al. | 241/34 |
| 6,719,226 | B2 * | 4/2004 | Rajewski | 241/30 |
| 7,742,863 | B2 * | 6/2010 | Brattberg | 701/51 |
| 2002/0017577 | A1 * | 2/2002 | Rajewski | 241/30 |
| 2002/0030130 | A1 * | 3/2002 | Ikegami et al. | 241/36 |
| 2004/0200914 | A1 | 10/2004 | Hishiyama et al. | |
| 2005/0173570 | A1 * | 8/2005 | Tanaka et al. | 241/36 |
| 2007/0131807 | A1 * | 6/2007 | Umeda et al. | 241/34 |
| 2009/0095827 | A1 * | 4/2009 | Posti et al. | 241/30 |

FOREIGN PATENT DOCUMENTS

| | | |
|---|---|---|
| GB | 2 211 004 | 6/1989 |
| WO | 2005/063398 | 7/2005 |
| WO | 2007/051890 | 5/2007 |

* cited by examiner

*Primary Examiner* — Bena Miller
(74) *Attorney, Agent, or Firm* — Morgan, Lewis & Bockius LLP

(57) ABSTRACT

There is described a crushing plant and a method for controlling the same. The crushing plant includes a crusher (1) and a feeding arrangement (3), and is driven by a diesel engine (13). A load value related to the diesel engine is retrieved e.g. by means of a J1939 interface. If the retrieved value exceeds a predetermined threshold value, the control loop of the feeding arrangement (3) is altered. Thereby it can be avoided that the diesel engine (13) stalls, such that continuous operation of the crushing plant may be ensured.

11 Claims, 4 Drawing Sheets

CRUSHING PLANT AND METHOD FOR CONTROLLING THE SAME

RELATED APPLICATION DATA

This application is a §371 National Stage Application of PCT International Application No. PCT/SE2008/000306 filed May 5, 2008 and claims priority under 35 U.S.C. §119 and/or §365 to Swedish Application No. 0701459-0, filed Jun. 15, 2007.

TECHNICAL FIELD

The present invention relates to a crushing plant comprising a crusher, a drive unit which drives the crusher, and a feeding arrangement which feeds raw material to the crusher, the feeding arrangement comprising means for regulating a raw material level in connection with the crusher.

BACKGROUND

Crushing plants of the above mentioned kind are well known and are used e.g. to refine blast rock into gravel. It is desirable to provide a mobile crushing plant that can easily be moved such that it can be operated at different locations, e.g. at a road construction site. One problem with mobile operation of a crushing plant is that raw material is often fed to the crusher unevenly over time which may cause interruptions in the operation of the crusher.

SUMMARY OF THE INVENTION

An object of the present invention is to provide a crushing plant which is suitable for mobile operation.

This object is achieved with a crushing plant as defined in claim 1 or by a method for controlling a crushing plant as defined in claim 10.

More specifically, a crushing plant of the initially mentioned kind then comprises a drive unit being a diesel engine, means for retrieving a parameter value which is correlated to the load of the diesel engine, means for comparing the retrieved value with a threshold value, and means for decreasing the feeding arrangement speed if the retrieved value exceeds the threshold value.

By using a diesel engine, the crushing plant may be driven independently of power grid connections. At the same time, it can be avoided to a great extent that the diesel engine stalls due to overload, thereby un-intentionally stopping the crusher.

The crushing plant may further comprise means for temporarily stopping the feeding arrangement if the retrieved value exceeds the threshold value. This reduces the risk of stalling of the diesel engine even further.

Additionally, the crushing plant may further comprise means for generating a warning if the retrieved value exceeds the threshold value. This informs the users of the crushing plant that the plant operates close to its maximum such that they may reduce the provision of new raw material into the feeding arrangement.

The feeding arrangement speed may be reduced by reducing a maximum output from a regulator controlling the feeding arrangement.

Alternatively or additionally, the feeding arrangement speed may be reduced by reducing a proportionality constant of a regulator controlling the feeding arrangement.

The load parameter value may be retrieved via a J1939 interface.

Alternatively, a hydraulic coupling may be arranged on a shaft between the diesel engine and the crusher, the crushing plant comprising means for retrieving first and second speed values relating to the in- and outgoing shafts of the hydraulic coupling, and means for providing the load value based on the difference between the first and second speed values.

The crusher may be a gyratory crusher, comprising a hopper mounted in connection with the crusher for providing raw material to the crusher, the raw material level being a level in the hopper, and the feeding arrangement being a conveyor belt.

Alternatively, the crusher may be a jaw crusher, comprising a vibration hopper mounted in connection with the crusher for providing raw material to the crusher, the raw material level being a level between the jaws of the crusher, and the feeding arrangement comprising a motor connected to the vibration hopper for providing a vibrating motion.

A method for controlling a crushing device of the initially mentioned kind includes retrieving a parameter value which is correlated to the load of the drive unit, wherein the drive unit is a diesel engine, comparing the retrieved value with a threshold value, and decreasing the feeding arrangement speed if the retrieved value exceeds the threshold value.

Further objects and features of the present invention will be apparent from the description and the claims.

DETAILED DESCRIPTION

Figure 1:
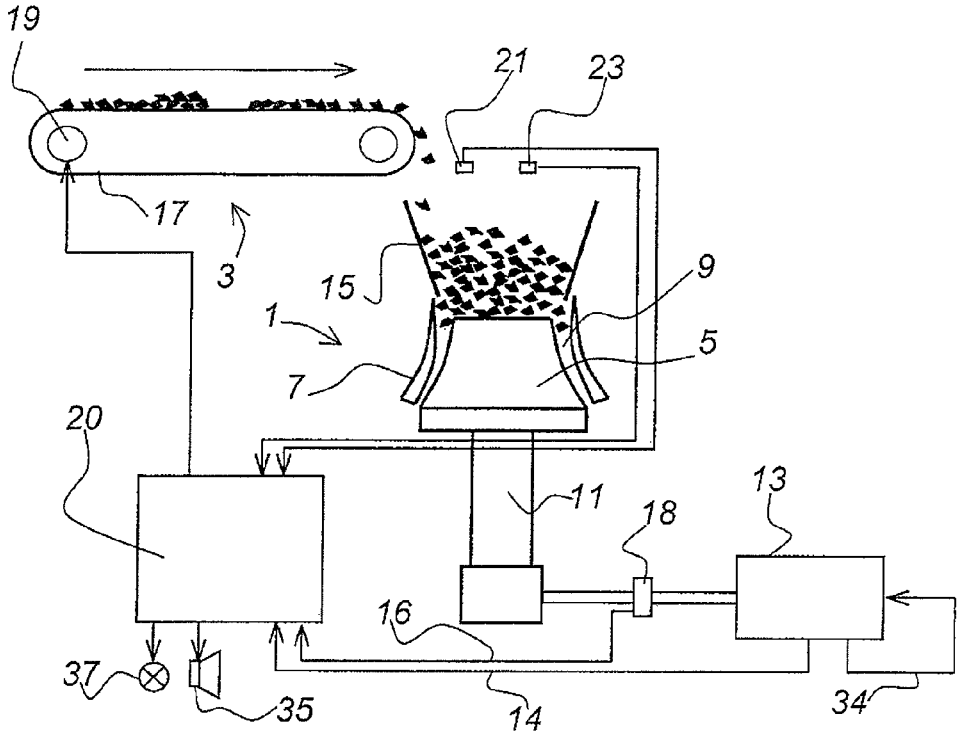
FIG. 1 illustrates schematically a crushing plant with a feeding arrangement.

FIG. 1 illustrates schematically a crushing plant with a crusher 1 and a feeding arrangement 3. In the illustrated case, the crusher 1 is a gyratory crusher with a conical crushing head 5 having an inner shell, and an outer shell 7, which is illustrated in cross-section. A ring-shaped crushing chamber 9 is formed between the inner and outer shells. The crushing head 5 is connected to a shaft 11 which gyrates under the influence of a drive unit 13 and makes the crushing head 5 carry out a combined rotating and oscillating movement which crushes raw material, typically blast rock, in the crushing chamber 9.

However, the present disclosure is equally relevant also in connection with other types of crushing plants, typically jaw crushers, as will be discussed in connection with FIG. 7.

A hopper 15, illustrated in cross-section, is placed on top of the crusher 1 to feed raw material into the latter. The feeding arrangement 3 is adapted for feeding material into the hopper 15 and comprises a conveyor belt 17, typically driven by a hydraulic motor 19, although for instance also electric motors are conceivable in this context.

It is desirable to accurately regulate the level of the raw material in the hopper 15 and in the crushing chamber, in order to obtain an efficient crushing function. This may be carried out by continuously or repeatedly measuring the raw material level in the hopper 15 and regulating the speed of the conveyor belt 17 accordingly, using a control unit 20. Measurements may be carried out e.g. by means of one or more ultrasonic sensors, as is well known per se. In the illustrated case, two sensors 21, 23 are used that measure the raw material level at two locations of the hopper 15. This is done to take into account the fact that the raw material level in the hopper 15 will not always be even. Therefore, the average of two or more level sensor signals will provide a more accurate measure of the overall raw material level.

Figure 2:
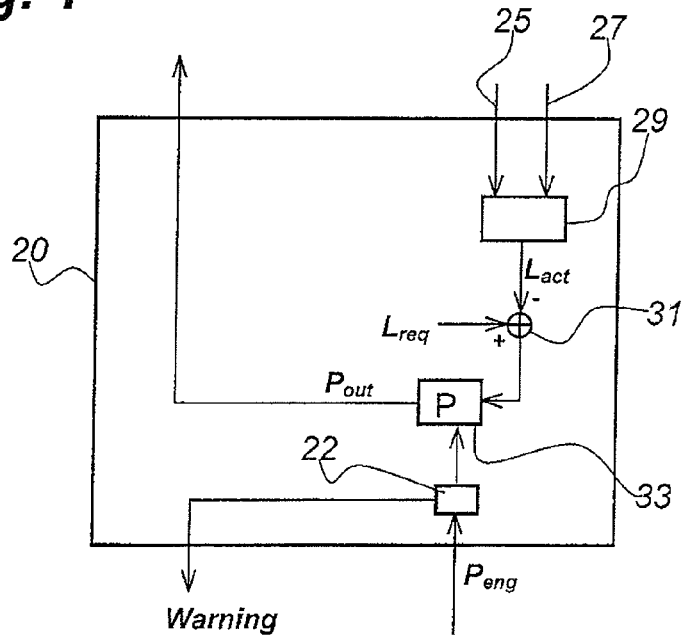
FIG. 2 illustrates a control block for the crushing plant of FIG. 1.

FIG. 2 illustrates in more detail the control unit 20 of the crushing plant in FIG. 1. First 25, and second 27 level sensor signals are provided to the control unit 20, and an averaging function block 29 calculates their average which will be an estimate $L_{act}$ of the actual raw material level in the hopper 15. The estimate is compared, using a summer 31, with a desired raw material level value $L_{req}$, which may be set by the user. This value may, as is known per se, be chosen to provide efficient crushing with an acceptable quality of the produced gravel with regard to its size distribution, shape, etc. The output of the summer 31 is a level error signal corresponding to $L_{req}$-$L_{act}$. The error signal is fed to a regulator 33, which in the illustrated case is a P-regulator, i.e. produces an output signal $P_{out}$, which is proportional to the input error signal, at least within a certain range. However, other types of regulators are possible, such as regulators additionally having an integrating and/or a differentiating component (i.e. PD-, PI-, or PID-regulators), or e.g. fuzzy logic regulators.

Returning to FIG. 1, the output signal of the regulator 33 controls the speed of the feeding arrangement 3, for instance by controlling a valve of the hydraulic motor 19 which runs the conveyor belt 17. The control arrangement described so far is capable of regulating the raw material level in the hopper 15 close to a desired level. The control arrangement described herein however has an additional function to improve the overall efficiency of the crushing plant.

The drive unit 13 of the crushing plant comprises a diesel engine which drives the crusher shaft 11 via a coupling unit (not shown). The use of a diesel engine makes the crushing plant suitable for a mobile configuration, as a connection to an electric power grid is not needed. The crusher can thus easily be moved from location to location and may therefore be used e.g. in connection with road construction, in order to refine blast rock to gravel. The diesel engine may be controlled, by means of a separate control loop 34, to run at a predetermined desired rotational speed, e.g. 1500 rpm.

A diesel engine functioning as the drive unit 13 may however stall if the power needed to run the crusher becomes too high. This may occur even if the raw material level is regulated to an optimal value, since the density of the material in the hopper 15 may be higher than expected, since the raw material may be harder than expected, or the raw material may be contaminated e.g. with junk or the like.

Therefore, a load parameter value $P_{eng}$ is retrieved from the diesel engine e.g. by means of a sensing line 14 (FIG. 2). The value is correlated to the load of the engine and may be retrieved using the J1939 interface, which is well known per se. Typically the retrieved parameter may be derived from the turbo-charging pressure and indicate a percentage 0-100% of the maximum load.

An alternative way of generating a load value is to measure the rotation speed on in- and outgoing shafts of a hydraulic coupling 18. The rotation speed of the ingoing shaft may be retrieved from a J1939 Interface or may be measured e.g. by means of an inductive sensor. The rotation speed of the outgoing shaft may be measured e.g. by means of an inductive sensor. The load value may be provided based on the difference between the first and second speed values, e.g. by means of a lookup table, and may be provided via a sensing line 16.

The load parameter value is fed to the control unit 20. The load parameter value may, if it indicates that the engine is close to stalling, affect the control loop of the feeding arrangement such that the feeding of material into the hopper is slowed down. The control unit 20 has a comparator 22 which compares the retrieved load parameter value with a predetermined threshold value, e.g. 80% of the maximum load. If the load parameter value exceeds this threshold, a potential overload condition is indicated. The comparator 22 thus adjusts a parameter of the regulator 33 as will be discussed further. Further, the regulator may be instructed to temporarily stop the feeding arrangement e.g. for a few seconds.

Additionally, the control unit 20 may provide a warning by acoustic and/or optic means, typically a summer 35 and/or a flashing lamp 37 (see FIG. 1), if the threshold is exceeded. Alternatively, the warning may be provided before the overload threshold is exceeded by comparing the retrieved parameter with a lower warning threshold (e.g. 70% of the maximum load).

Figure 3:
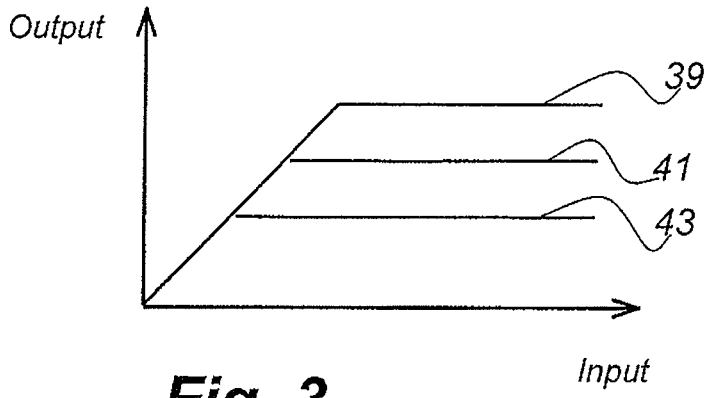
FIGS. 3-5 illustrate different error level to rotation speed control schemes.
Figure 4:
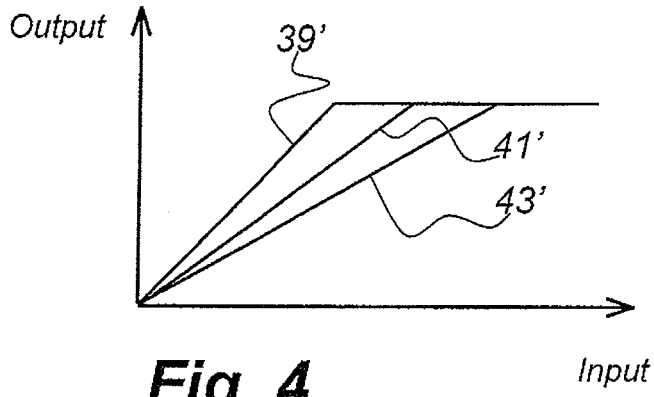
Figure 5:
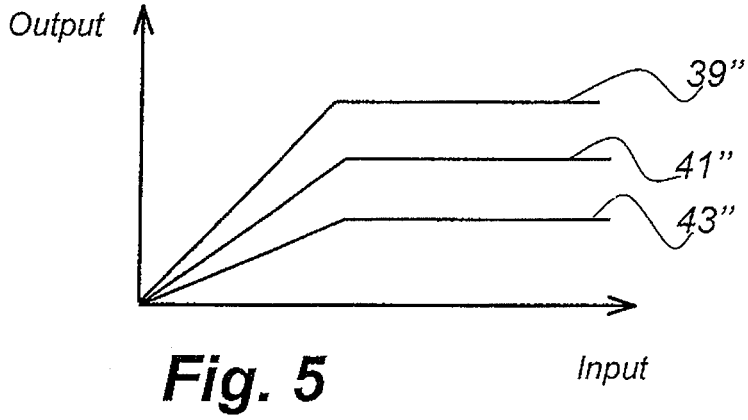

FIGS. 3-5 illustrate different error level (input) to rotation speed (output) control schemes. FIG. 3 illustrates a first case, where a maximum output level is adjusted if a potential overload condition is indicated. The graph 39 thus shows the P-regulator characteristics when no such condition has occurred. The output signal is proportional to the input error signal within a certain range. For even higher error signals, a maximum output level is provided to the conveyor belt motor. Once an overload condition has occurred, the maximum level is lowered as illustrated by the graph 41, which may e.g. correspond to a 100 rpm lower maximum speed level. Yet another overload condition may make the regulator use a yet lower maximum value as illustrated by the graph 43.

FIG. 4 illustrates a first alternative scheme. In this case, the proportionality constant of the P-regulator is altered by the overload condition occurrence, such that a specific error signal increase results in a comparatively lower output signal increase as illustrated by graphs 39' (no overload condition), 41' (overload condition once), and 43' (overload condition twice). The maximum output is not altered.

FIG. 5 illustrates a combination of the two previously described schemes, namely where both the maximum output and the proportionality constant are decreased by an overload condition, as illustrated by graphs 39", 41", and 43".

Figure 6:
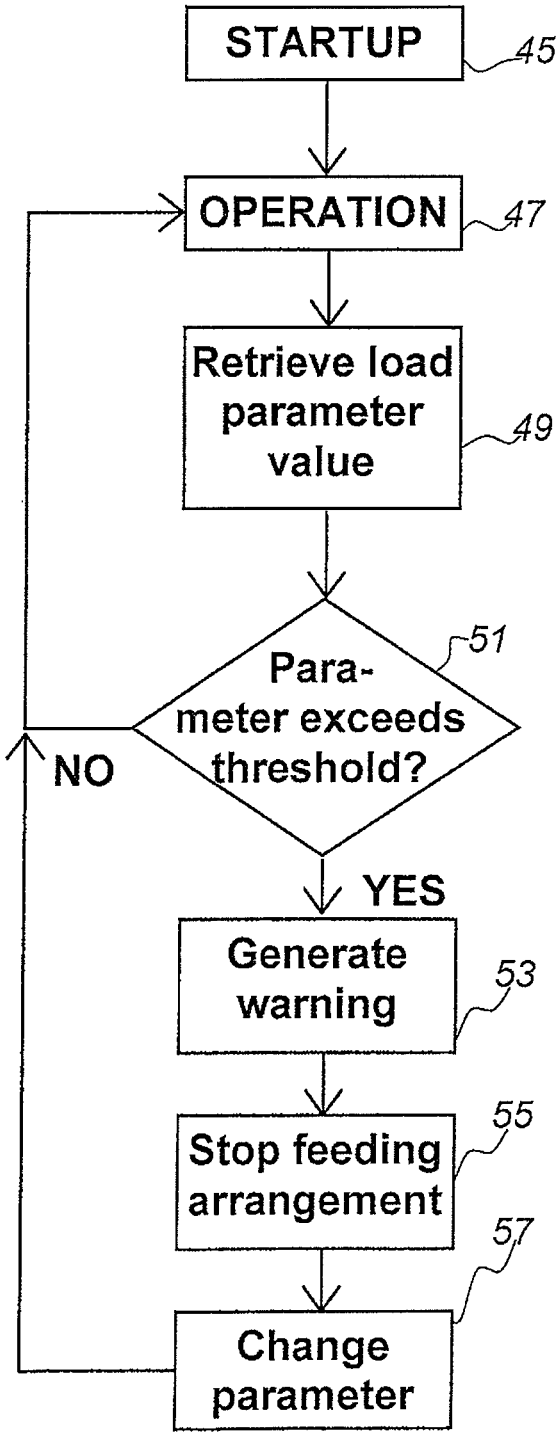
FIG. 6 illustrates a method for controlling a crushing plant.

FIG. 6 illustrates a method for controlling a crushing plant. From an initial start-up state 45, the crushing plant enters an operating state 47 where raw material is refined into gravel. While in the operating state, a load parameter value is retrieved 49 from the diesel engine or from speed monitoring, and is compared 51 with a threshold. If the threshold is exceeded, indicating a potential overload condition, a warning is optionally generated 53, e.g. as mentioned by flashing a light, and the feeding arrangement is optionally stopped 55 during a predetermined time period. A control parameter in the control loop of the feeding arrangement is then changed 57 to provide a slower feeding, such that stalling of the diesel engine can be avoided. The crushing plant then continues in the operating mode and repeats the measuring procedure within a predetermined time. The speed may thus be decreased further. If the comparing 51 gives the result that the load parameter value is lower than the threshold, the operation of the crushing plant is simply continued. If a parameter has been changed and no new overload condition occurs within a predetermined time, the parameter may be restored back to its previous value.

Figure 7:
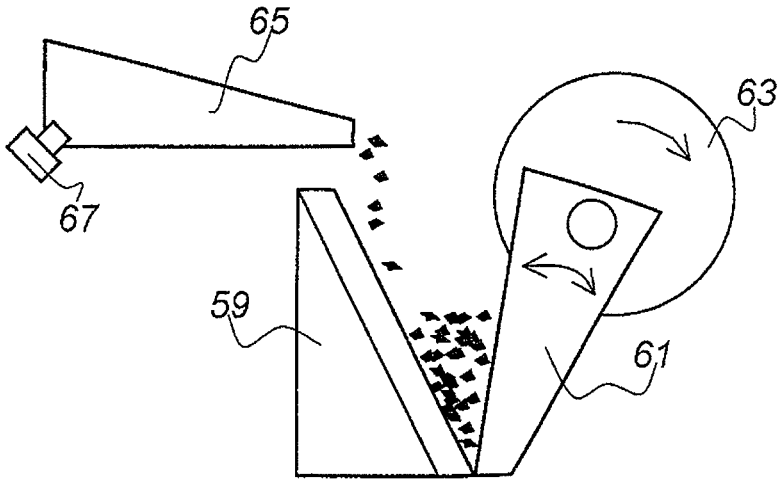
FIG. 7 illustrates schematically a crushing plant with a jaw crusher.

FIG. 7 illustrates schematically a crushing plant with a jaw crusher. The controlling method may be utilized also in connection with such a plant, using any of the control schemes.

The jaw crusher comprises a fixed crushing jaw 59 and a swinging crushing jaw 61, the latter reciprocating against the fixed crushing jaw 59, due to the rotation of a flywheel 63, in order to crush raw material between the jaws. A feeding arrangement comprises a vibration feeder/hopper 65, which is vibrated by means of a vibration motor 67 in order to stimulate the vibration feeder to feed raw material to the crusher. In this case, the vibration motor 67 speed is decreased if the load of the drive unit driving the crusher becomes too high. The raw material level measured may be the level of material in between the crusher jaws.

In summary, there is described a crushing plant and a method for controlling the same. The crushing plant includes a crusher and a feeding arrangement, and is driven by a diesel engine. A load value is retrieved which is related to the diesel engine e.g. by means of a J1939 interface. If the retrieved value exceeds a predetermined threshold value, the control loop of the feeding arrangement is altered. Thereby it can be avoided that the diesel engine stalls, such that continuous operation of the crushing plant may be ensured.

The invention is not restricted to the described embodiments and may be varied within the scope of the appended claims.

The disclosures in the Swedish patent application No. 0701459-0, from which this application claims priority, are incorporated herein by reference.

The invention claimed is:

1. A crushing plant comprising a crusher;

a drive unit which drives the crusher, and a feeding arrangement which feeds raw material to the crusher, the feeding arrangement comprising means for regulating a raw material level in connection with the crusher, wherein the drive unit being a diesel engine, wherein the crushing plant further comprises:

means for retrieving a parameter value which is correlated to the load of the diesel engine, means for comparing the retrieved value with a threshold value, and means for decreasing the feeding arrangement speed if the retrieved value exceeds the threshold value, and wherein a hydraulic coupling is arranged on a shaft between the diesel engine and the crusher, the crushing plant comprises means for retrieving first and second speed values relating to the in- and outgoing shafts of the hydraulic coupling, and means for providing the load parameter value based on the difference between the first and second speed values.

2. A crushing plant according to claim 1, further comprising means for temporarily stopping the feeding arrangement if the retrieved value exceeds the threshold value.

3. A crushing plant according to claim 1, further comprising means for generating a warning if the retrieved value exceeds the threshold value.

4. A crushing plant according to claim 1, wherein the feeding arrangement speed is reduced by reducing a maximum output from a regulator controlling the feeding arrangement.

5. A crushing plant according to claim 1, wherein the feeding arrangement speed is reduced by reducing a proportionality constant of a regulator controlling the feeding arrangement.

6. A crushing plant according to claim 1, wherein the load parameter value is retrieved via a J1939 interface.

7. A crushing plant according to claim 1, wherein the crusher is a gyratory crusher, comprising a hopper mounted in connection with the crusher for providing raw material to the crusher, the raw material level being a level in the hopper, and the feeding arrangement is a conveyor belt.

8. A crushing plant according claim 1, wherein the crusher is a jaw crusher, comprising a vibration hopper mounted in connection with the crusher for providing raw material to the crusher, the raw material level being a level between the jaws of the crusher, and the feeding arrangement comprising a motor connected to the vibration hopper for providing a vibrating motion.

9. A method for controlling a crushing plant comprising a crusher, a drive unit which drives the crusher, and a feeding arrangement which feeds raw material to the crusher, the feeding arrangement comprising means for regulating a raw material level in connection with the crusher, the method comprising:

retrieving a parameter value which is correlated to the load of the drive unit, wherein the drive unit is a diesel engine, a hydraulic coupling being arranged on a shaft between the diesel engine and the crusher, comparing the retrieved value with a threshold value, and decreasing the feeding arrangement speed if the retrieved value exceeds the threshold value, wherein retrieving the parameter value includes retrieving first and second speed values relating to the in- and outgoing shafts of the hydraulic coupling, and providing the load parameter value based on the difference between the first and second speed values.

10. A method according to claim 9, wherein a warning is generated if the retrieved value exceeds the threshold value.

11. A method according to claim 9, wherein the feeding arrangement is temporarily stopped if the retrieved value exceeds the threshold value.

* * * * *